US006142612A

United States Patent [19]

Whitman

[11] Patent Number: 6,142,612

[45] Date of Patent: Nov. 7, 2000

[54] CONTROLLED LAYER OF TANTALUM FOR THERMAL INK JET PRINTER

[75] Inventor: Charles Spencer Whitman, Lexington, Ky.

[73] Assignee: Lexmark International, Inc., Lexington, Ky.

[21] Appl. No.: 09/186,904

[22] Filed: Nov. 6, 1998

[51] Int. Cl.[7] ..... B41J 2/05

[52] U.S. Cl. ..... 347/63; 347/64

[58] Field of Search ..... 347/63, 64, 67

[56] References Cited

U.S. PATENT DOCUMENTS

| | | | |
|---|---|---|---|
| 4,596,994 | 6/1986 | Matsuda et al. | 347/64 |
| 4,931,813 | 6/1990 | Pan et al. | 346/104 R |
| 4,956,653 | 9/1990 | Braun | 347/63 |
| 4,965,611 | 10/1990 | Pan et al. | 346/1.1 |
| 5,057,865 | 10/1991 | Takagi et al. | 346/140 R |
| 5,113,203 | 5/1992 | Takagi et al. | 346/140 R |
| 5,148,191 | 9/1992 | Hasegawa et al. | 346/140 R |
| 5,420,618 | 5/1995 | Sekiya et al. | 347/9 |
| 5,892,526 | 4/1999 | Asai | 347/62 |

FOREIGN PATENT DOCUMENTS

| | | | |
|---|---|---|---|
| 0 750 991 | 1/1997 | European Pat. Off. | B41J 2/14 |

*Primary Examiner*—John Barlow
*Assistant Examiner*—Juanita Stephens
*Attorney, Agent, or Firm*—John A. Brady

[57] ABSTRACT

A thermal ink jet printhead has a protective layer of Ta with an optimum thickness of about 9,000 A deposited on a protective layer of SiC under deposition conditions determined by a regression equation. The protective layer of SiC has an optimum thickness of about 5,000 A. The life of a thermal ink jet printhead having these two optimum thicknesses is at least twenty times the life of a thermal ink jet printhead not having these two optimum thicknesses in at least one embodiment. Etching of the layer of SiC prior to depositing the layer of Ta further increases the life of a thermal ink jet printhead.

8 Claims, 7 Drawing Sheets

CONTROLLED LAYER OF TANTALUM FOR THERMAL INK JET PRINTER

FIELD OF THE INVENTION

This invention relates to a method for depositing a layer of tantalum (Ta) on a thermal ink jet printhead and to a thermal ink jet printhead having at least the thickness of an outer protective layer of Ta controlled and, more particularly, to a method for depositing a layer of Ta on a thermal ink jet printhead by sputtering under controlled conditions to have a controlled thickness and to a thermal ink jet printhead having its outermost protective layer of Ta of a controlled thickness.

BACKGROUND OF THE INVENTION

Thermal ink jet printheads have previously been formed in an area of a silicon substrate coated with silicon dioxide ($SiO_2$). A resistive heating layer of an alloy of tantalum and aluminum (TaAl), for example, is disposed on top of the layer of $SiO_2$. A layer of aluminum is deposited over portions of the layer of TaAl to leave remaining portions of the layer of TaAl exposed. The exposed portions of the layer of TaAl between the spaced portions of aluminum, which supply the current to the layer of TaAl, form resistors or heaters. The resistors or heaters form bubbles of ink when current flows through the layer of TaAl between the spaced portions of the layer of aluminum to heat the ink.

Protective layers are formed over the patterned aluminum layer and the exposed portions of the layer of TaAl. Previously suggested thermal ink jet printheads had a layer of silicon nitride ($Si_3N_4$) deposited over the patterned aluminum layer and the exposed portions of the layer of TaAl by plasma enhanced chemical vapor deposition (PECVD). Next, a layer of silicon carbide (SiC) was deposited over the layer of $Si_3N_4$ by PECVD. Finally, a layer of Ta was sputtered onto the layer of SiC.

Ink, which is transformed into bubbles by the heat of the resistors, overlies the Ta layer. Thus, the ink must be heated by the resistors through the protective layers of $Si_3N_4$, SiC, and Ta.

The protective layers of $Si_3N_4$, SiC, and Ta protect the resistors from cavitation due to the ink bubbles collapsing after being generated and from chemical attack such as corrosive effects due to the turbulent ink and vapor. However, as the thickness of the protective layers is increased, it is more difficult to heat the ink through the protective layers because the protective layers impede the dissipation of heat.

Accordingly, as the total thickness of the protective layers has increased, it has previously been suggested to use current pulse of long times (widths) to apply sufficient heat to the ink to form the droplets. Longer pulse widths imply a lower power density to the heater. Lower power density has been correlated to lower print quality. Therefore, these relatively long pulse widths may degrade print quality.

A crack in the protective layers may lead to a failure of a resistor or heater. As the number of the resistors or heaters failing increases so as to not produce satisfactory print quality, the printhead fails.

SUMMARY OF THE INVENTION

The present invention increases the life of a thermal ink jet printhead without requiring any increase in the pulse width of the current supplied to produce ink bubbles of a size to have satisfactory print quality. While the present invention increases the thickness of the layer of Ta to about 50% in its optimum over the thickness of the previously used Ta layer in a thermal ink jet printhead, no increase in current pulse width is required to produce satisfactory ink bubbles.

The present invention accomplishes this by controlling at least three factors in sputtering Ta onto the layer of SiC on an ink jet silicon heater chip. In a three chamber, color ink jet printhead, these three factors are Ta sputtering time, SiC sputtering time, and the time for a reactive ion etch (RIE) on the layer of SiC prior to sputtering Ta.

Through using a regression equation to determine the optimum magnitudes of Ta sputtering time, SiC sputtering time, and the time for a reactive ion etch (RIE) on the layer of SiC and long-term life tests on the three chamber, color ink jet printheads formed with various magnitudes for each of Ta sputtering time, SiC sputtering time, and the time for a reactive ion etch (RIE) on the layer of SiC, it has been discovered that these three factors significantly increase the life of a thermal ink jet printhead.

Two other sputtering factors considered were the use of an HF dip and the means for shut off of flow for depositing the SiC. Each had only two levels, and neither improved printhead life in one of its two levels so that neither was required to improve the printhead life.

By controlling the magnitudes of the three factors, it is believed that continuously increasing the thickness of the layer of Ta will not always produce a longer printhead life but that there is an optimum thickness. It also has been discovered that increasing the thickness of the layer of SiC, which is deposited by PECVD, further increases the life of the ink jet printhead regardless of the thickness of the Ta layer. However, when the layer of Ta is at a thickness of about 9,000 A (Angstrom), increasing the thickness of the SiC layer optimizes the increase in printhead life.

In single chamber, monochromatic thermal ink jet printheads produced by a different process, it was discovered that controlling five factors or parameters in sputtering Ta onto the layer of SiC also will substantially increase the life of a thermal ink jet printhead.

These five factors are the time of an in situ pre-sputter etch (PSE) on the layer of SiC, Ta sputtering time, power density, substrate temperature (T), and the voltage bias on the substrate. The optimum magnitudes of these five parameters for printhead life are determined by the use of another regression equation.

An object of this invention is to improve the life of a drop-on-demand thermal ink jet printhead.

Another object of this invention is to improve the life of resistors or heaters of a thermal ink jet printhead.

A further object of this invention is to improve the life of a thermal ink jet printhead by using a regression equation to determine optimum conditions for depositing at least a protective layer of Ta.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
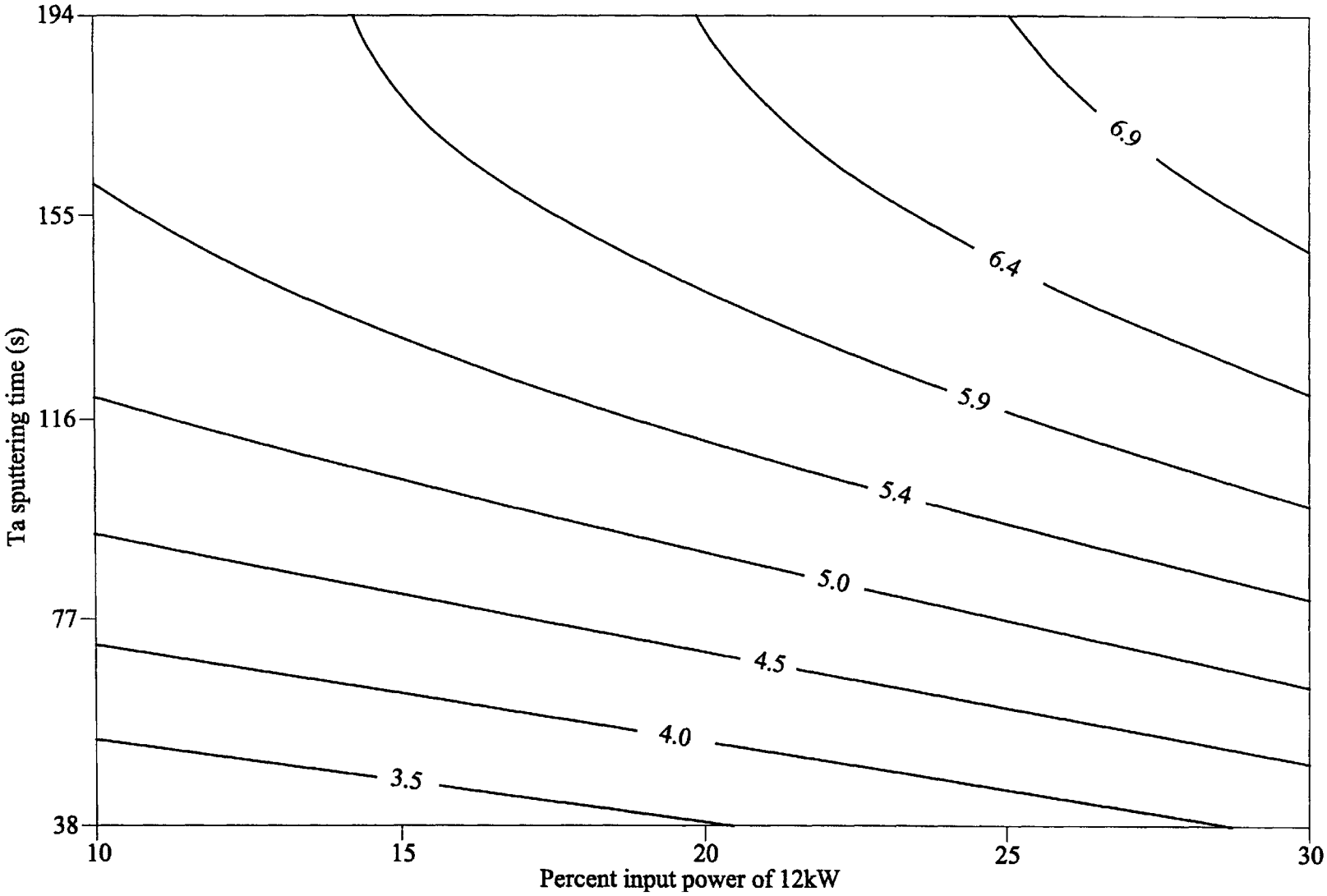
FIG. 1 is a contour plot showing the predicted average (natural log) life of a single chamber, monochrome printhead for different sputter times and sputter power when PSE time=0 seconds, bias=0 volts, and T=100° C.

Using an I-Optimal experimental design, deposition conditions for sputtering a Ta layer on a SiC layer were optimized for resistor or heater life of a single chamber, monochrome ink jet printhead. Sputtering was performed in a Varian 3190 sputtering apparatus. I-Optimal designs are commercially available experimental designs which minimize the average variance of prediction. Thus, the predictions of a regression equation formed using an I-Optimal design will have narrower confidence bounds than other types of designs.

Five factors or parameters were selected as the deposition conditions to be controlled for controlling the thickness of the Ta layer to optimize the resistor or heater life. These were PSE time prior to Ta deposition, Ta sputtering time, density of the power to the Ta target during sputtering, temperature of the substrate, and substrate bias during Ta deposition. The ranges of these five factors or parameters were varied as follows: PSE from 0 to 300 seconds, sputtering time from 37.9 to 194 seconds, power density from 10–30% of 12 kW, T from 100° C. to 300° C., and substrate bias from 0 to −300 volts.

Using STRATEGY regression software sold by Process Builder, Inc., Seattle, Wash., regression coefficients of an empirical model were produced using the data of Table 1. The empirical model is a second order equation which predicts the natural log of the average life of a single chamber, monochromatic ink jet printhead having heaters or resistors formed with a Ta protective layer as its top protective layer over protective layers of SiC and $Si_3N_4$.

The average life also may be called the median time to failure (MTTF). Long-term life tests were conducted on single chamber, monochromatic ink jet printheads made under various sputtering conditions as set forth in Table I. The MTTF in millions of fires (M) of each of the 24 runs producing 173 datapoints is included in Table I.

TABLE I

| Run | Time | Bias | Power | PSE | Temp. | Observed MTTF (M) and Range* | Observed Thickness (A) and Range* | Avg. |
|---|---|---|---|---|---|---|---|---|
| 1 | 121.6 | −140 | 18 | 134.4 | 203.1 | 339 [324, 355] | 5100 [3475, 6725] | |
| 2 | 37.9 | −110 | 30 | 208.2 | 100 | 95 [74, 123] | 2530 3220] | [1850, |
| 3 | 193.6 | −260 | 30 | 18 | 300 | 1615 [1226, 2127] | 14000 | |
| 4 | 37.9 | −190 | 10 | 0 | 300 | 49 [44, 55] | 1050 [835, 1265] | |
| 5 | 194 | −10 | 30 | 0 | 143.1 | 1551 [1047, 2298] | 12765 [9035, 16500] | |
| 6 | 194 | −300 | 10 | 0 | 179.8 | 273 [233, 320] | 4980 [3550, 6415] | |
| 7 | 194 | 0 | 30 | 268.2 | 300 | 1245 [912, 1700] | 12615 [8775, 16460] | |
| 8 | 194 | −300 | 22 | 219.6 | 100 | 757 [629,911] | 9450 [6435, 12465] | |
| 9 | 117.4 | 0 | 300 | 100 | 367 | 5250 [320, 422] | [3635, 6865] | |
| 10 | 194 | −150 | 10 | 300 | 209.7 | 264 [231,328] | 5050 6130] | [3965, |
| 11 | 37.9 | 0 | 15 | 0 | 100 | 27 [19, 38] | 1430 1790] | [1075, |
| 12 | 37.9 | −300 | 20 | 85.2 | 217.8 | 1730 [58, 88] | [1260, 2200] | |
| 13 | 121.6 | −140 | 18 | 134.4 | 203.1 | 352 [257,484] | 5120 6600] | [3635, |
| 14 | 37.9 | −300 | 10 | 300 | 100 | 41 [31, 54] | 980 [725, 1240] | |
| 15 | 56.8 | 0 | 30 | 18 | 300 | 177 [143, 220] | 3920 4960] | [2875, |
| 16 | 189.4 | 0 | 10 | 0 | 300 | 217 [170,277] | 4865 6135] | [3600, |
| 17 | 96.7 | −300 | 30 | 0 | 100 | 470 | 6250 | [4310, |

TABLE I-continued

| Run | Time | Bias | Power | PSE | Temp. | Observed MTTF (M) and Range* | Observed Thickness (A) and Range* | Avg. |
|---|---|---|---|---|---|---|---|---|
| | | | | | | [382, 579] | 8190] | |
| 18 | 194 | 0 | 10 | 136.2 | 100 | 358 [286, 449] | 5050 6555] | [3545, |
| 19 | 37.9 | −160 | 19 | 300 | 300 | 49 [41, 58] | 4000 4655] | [3340, |
| 20 | 110.3 | −160 | 10 | 56.4 | 100 | 151 [134, 172] | 3300 4115] | [2485, |
| 21 | 37.9 | 0 | 10 | 219.6 | 232.6 | 32 [18, 56] | 1050 [800, 1300] | |
| 22 | 134.1 | −300 | 10 | 208.2 | 300 | 171 [154, 190] | 3465 4615] | [2320, |
| 23 | 111.4 | −300 | 30 | 300 | 211.2 | 590 [463, 753] | 7100 9150] | [5050, |
| 24 | 121.6 | −140 | 18 | 134.4 | 203.1 | 349 [314,389] | 5065 6430] | [3705, |

*Range is 95% confidence interval.

FIG. 1 is a contour plot of sputter time and sputter power versus the predicted average (natural log) life of a single chamber, monochromatic ink jet printhead when PSE=0, bias=0, and T=100° C. From FIG. 1, with a nominal setting of a sputtering time of about 100 seconds and power density=25%, the predicted life would be in an area where the natural log of the MTTF varies from 5.4 to 5.9.

The actual predicted natural log life of the single chamber, monochromatic printhead is determined by the following regression equation:

$$\ln(\text{life})=5.89318+1.17552TM+0.06171B+0.70097P-0.02995PSE-0.06278T-0.56754TM^2-0.10191TM\times B+0.1816TM\times P-0.00744TM\times PSE-$$

$$0.15301TM\times T-0.07658B^2+0.0129B\times P-0.07634B\times PSE+0.02594B\times T+0.06623P^2-0.03209P\times PSE+0.03181P\times T-0.0488PSE^2-0.17276PSE\times T-0.05676T^2 \quad (1).$$

In equation (1), TM represents a coded sputtering time for the Ta layer where coded sputtering time=(time−115.95)/78.05, B represents a coded bias on the substrate where coded bias=(bias−150)/150 with bias on the substrate being its absolute value in volts, P represents a coded per cent of sputtering power where coded power=(power-20)/10, PSE represents a coded pre-sputter etch time where coded PSE=(PSE-150)/150, and T represents a coded temperature of the substrate where coded temperature=(temperature−200)/100.

The coding forces the range of the levels of each parameter to be from −1 to +1. As an example, if TM=150 seconds, coded time=0.436; if B=−100 volts, coded bias=−0.333; if P=20%, coded power=0; if PSE=250 seconds, coded PSE=0.667; and if T=150° C., coded temperature=−0.5.

Equation (1) gives the natural log of the predicted life of a single chamber, monochromatic printhead as 5.52. For the nominal settings of FIG. 1, the predicted life is $e^{5.52}$=250 M with 95% confidence bounds of [190 M, 320 M]. These nominal settings are PSE=0, bias=0, T=100° C., Ta sputtering time of about 100 seconds, and power density=25%.

Life tests performed on hundreds of single chamber, monochromatic printheads, which were made using the nominal settings of FIG. 1, produced a resulting MTTF of 298 M [288 M, 309 M]. Thus, the empirical model or regression equation (equation (1)) predicts the resistor or heater life under nominal conditions very well.

Another test for ascertaining if equation (1) predicts correctly is to determine its prediction of the MTTF near the center of an experimental "cube." Each of the five sputter factors or conditions can be considered one axis in experimental space.

The center of this five dimensional "cube" will have settings at the center of the range of each of the five variable sputter conditions. Thus, the center would be at PSE=150 seconds, Ta sputtering time=116 seconds, power=20% of 12 kw, T=200° C., and bias=−150 volts.

If all experiments were performed on the corners or along the edges of the "cube" and none at the center, then the most difficult region to predict would be at the center since it is farthest from any known data. However, runs 1, 13, and 24 of Table I were selected to be near the center so that they can be used to test the empirical model (equation (1)).

Withholding the runs 1, 13, and 24 of Table I from the analysis provides certain regression coefficients but only slightly different from equation (1). These coefficients predict that the MTTF for runs 1, 13, and 24 should be 293 M [190 M, 450 M].

According to Table I, the MTTF for runs 1, 13, and 24 were 339 M, 352 M, and 349 M, respectively. Each of these has a natural log reasonably close to the natural log of 293 M since the natural logs are much closer to each other than the exponentials of the natural logs.

Accordingly, the empirical model can be used to accurately predict within the experimental "cube." For example, at maximum power of 30% of 12 kW and maximum sputtering time of 194 seconds with T=100° C., bias=0 volts, and PSE=0 seconds, the predicted MTTF is 1570 M [1110 M, 2210 M]. Run 5 of Table I was selected with its conditions very close to these values. The MTTF for run 5 was 1551 M [1050 M, 2300 M] so as to be in very close agreement with the predicted MTTF of 1570 M.

As previously mentioned, the MTTF has been 298 M from life tests performed on hundreds of single chamber, monochromatic printheads made with the nominal settings of FIG. 1. Thus, using the conditions of run 5 of Table I to produce a printhead (1570 M) creates a huge improvement over the life of presently available thermal ink jet printheads (298 M).

Each of the deposition runs included a test wafer. The test wafer was subsequently patterned, and Ta thickness measurement was obtained with a profilometer.

Figure 2:
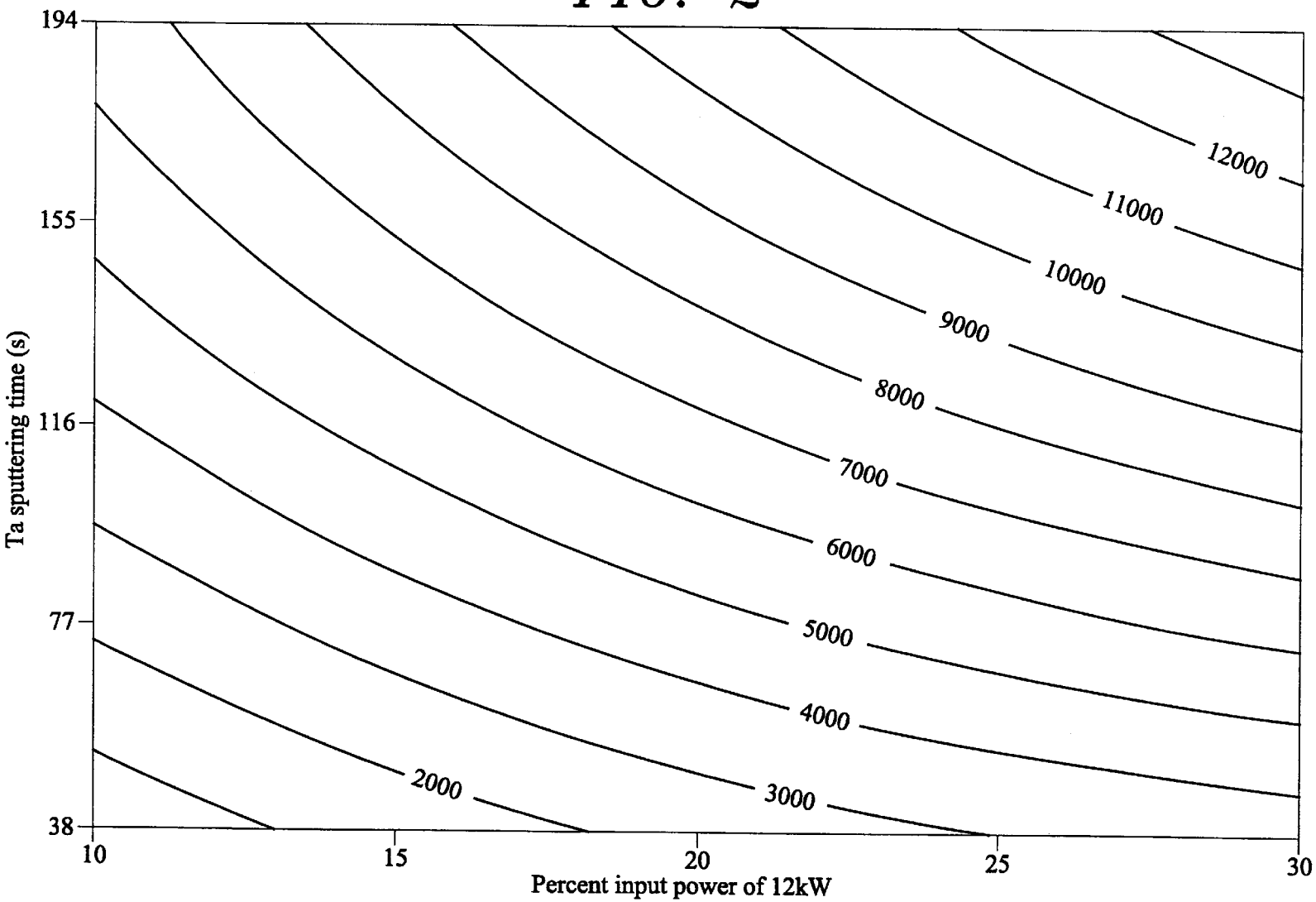
FIG. 2 is a contour plot showing the predicted thickness of the Ta layer of a single chamber, monochrome printhead for different sputter times and sputter power when PSE time=0 seconds, bias=0 volts, and T=100° C.

The thickness of the Ta layer is a function of its deposition conditions. FIG. 2 shows a maximum Ta thickness being attained at 194 seconds with a power density of 30% of 12 kW. The predicted maximum Ta thickness for these conditions is 15,000 A [14,000 A, 16,100 A). From the contour plot of FIG. 2, it can be observed that the power and time are interacting synergistically. Since the printhead life, which is shown in FIG. 1, and the Ta thickness, which is shown in FIG. 2 in 1000 A increments, have similar behavior, much of the improvement in the life of a thermal ink jet printhead is due to the increased thickness of the Ta layer.

However, the other sputtering conditions also can affect the life of the printhead. If no PSE is desired while running at maximum time, maximum power, a bias of −300 volts, and a substrate temperature of 225° C., the MTTF would increase to 1,710 M [1330 M, 2200 M]. Run 3 of Table I was made under slightly different conditions; it had a MTTF of 1615 M [1230 M, 2130 M] which is in close agreement with the prediction of 1710 M. The predicted thickness under these conditions is 14,100 A [13,250 A, 15,000 A], which indicates that the improved life of the printhead is not solely a function of the thickness of the Ta layer.

If the maximum time of PSE=300 seconds is practicable, setting the bias to 0 volts and the temperature at 100° C. results in the empirical model (equation (1)) predicting the overall maximum MTTF to be 2,340 M [1,520 M, 3,600 M]. This is another huge improvement in the life of a thermal ink jet printhead.

For any intermediate values of PSE time between 0 and 300 seconds, the values of the bias and the temperature must be changed to maximize the life of the printhead. The specific values can be determined with equation (1).

In addition to testing single chamber, monochrome ink jet printheads, a color ink jet printhead having three chambers of ink was tested and had a regression equation produced through the use of a five factor I-optimal design. These color printheads were produced in a different manner by a different manufacturer than the monochrome printheads.

Accordingly, five factors or parameters were again chosen but these were different than for the monochrome printhead. One was an HF dip prior to Ta deposition. Two chosen levels of the HF dip were dip and no dip.

A second factor was the manner of shut off of the SiC deposition. In depositing the SiC layer by PECVD, reactive gases (methane and silane) flow past wafers, which are surrounded by plasma.

In the standard shutoff, the flow of methane is initially turned off after which the flow of silane is stopped. Then, the plasma is turned off. An alternate way to end the PECVD is to shut off both gases simultaneously and then perform a fast purge.

A third parameter was the sputtering time, which determines the Ta thickness. The nominal thickness is 6,000 A.

The deposition time for the SiC layer is another of the five factors. The nominal thickness of the SiC layer is 2,600 A.

As previously discussed, the testing of the monochrome printhead disclosed that an in situ PSE prior to Ta deposition can improve the life of the resistor or heater. However, the process used by the manufacturer of the color printhead cannot perform a PSE. Accordingly, a reactive ion etch (RIE) was performed on the SiC layer after which wafers were transferred to another tool for Ta deposition within 24 hours. The time of the RIE is the fifth factor.

Twenty-four experimental runs of the color ink jet printhead were performed as shown in Table II. The experimental wafers for each run were randomly chosen from four wafer lots with each run having four wafers.

TABLE II

| Run Order | HF Dip | Shut-off | Ta target thickness (A) | SiC target thk. (A) | RIE time in seconds | No. tested | Observed MTTF and Range* (M) |
|---|---|---|---|---|---|---|---|
| 1 | 1 | −1 | 6,000 | 2,250 | 20 | 7 | 17[14,21] |
| 2 | −1 | −1 | 9,000 | 3,560 | 0 | 12 | 137[100, 187] |
| 3 | 1 | 1 | 9,000 | 0 | 40 | 7 | 6[3, 14] |
| 4 | —1 | 1 | 3,000 | 0 | 40 | 8 | 2.3[1.8, 3.2] |
| 5 | 1 | −1 | 9,000 | 0 | 0 | 2 | 14[5, 42] |
| 6 | 1 | 1 | 3,000 | 0 | 20 | 8 | 2.4[2, 2.8] |
| 7 | 1 | −1 | 9,000 | 5,000 | 40 | 12 | 161[119, 218] |
| 8 | 1 | 1 | 6,000 | 3,560 | 0 | 8 | 34 [25, 48] |
| 9 | 1 | −1 | 6,000 | 5,000 | 0 | 12 | 105 [66, 167] |
| 10 | 1 | −1 | 3,000 | 5,000 | 20 | 8 | 27 [22, 33] |
| 11 | −1 | −1 | 6,000 | 0 | 0 | 8 | 11 [7, 17] |
| 12 | −1 | 1 | 6,000 | 1,175 | 20 | 8 | 15[11, 20] |
| 13 | 1 | −1 | 6,000 | 2,250 | 20 | 8 | 18[11, 31] |
| 14 | −1 | 1 | 3,000 | 5,000 | 0 | 8 | 30[23, 39] |
| 15 | −1 | −1 | 9,000 | 0 | 40 | 0 | — |
| 16 | 1 | −1 | 6,000 | 0 | 40 | 0 | — |
| 17 | −1 | 1 | 9,000 | 0 | 0 | 8 | 30[23, 40] |
| 18 | 1 | −1 | 3,000 | 2,250 | 0 | 8 | 9[7, 11] |
| 19 | −1 | 1 | 6,000 | 5,000 | 40 | 6 | 61[55, 68] |
| 20 | −1 | 1 | 3,000 | 1,175 | 0 | 8 | 7[4, 10] |
| 21 | −1 | −1 | 3,000 | 3,560 | 40 | 8 | 9[7, 13] |
| 22 | 1 | 1 | 3,000 | 3,560 | 40 | 8 | 15[13, 18] |
| 23 | −1 | 1 | 9,000 | 5,000 | 20 | 11 | 48[38, 60] |
| 24 | 1 | −1 | 6,000 | 2,250 | 20 | 7 | 35[26, 48] |

*Range is a 95% confidence interval.
HF = 1, dip;
HF =1, no dip.
Shutoff = 1, alternate shutoff;
shutoff = −1, standard shutoff.

The HF dip used a 10:1 HF solution by volume for 30 seconds at 26° C. The delay time between the RIE of the SiC layer and sputtering of the Ta layer was less than 24 hours.

The deposition time for each of the SiC and Ta layers controlled the thickness of each of the SiC and Ta layers. All SiC and $Si_3N_4$ thickness measurements were made by a prism coupler in a single spot on a monitor wafer.

A single wafer from each group of four wafers was randomly chosen and built up into about 16 printheads. Approximately eight of the printheads were randomly picked for life testing. The printheads were life tested by using the same single color ink in each of the three chambers rather than a separate colored ink in each chamber under standard conditions of 6.5 kHz, 2 microsecond pulse width, and 50% duty cycle.

The printhead was considered to have failed after the first heater or resistor failed with all failures being confirmed optically. The number of the fires to failure was recorded for each printhead. The printheads were run in a random order.

Using the same regression software as employed with the monochrome printhead, the following regression equation was obtained for the color printhead:

$$\ln(\text{life})=3.09117-0.18107HF-0.21432SF+0.82108TT+0.92734CT+0.04659RT-0.09982HF\times SF-0.45165HFTT+0.06114HF\times CT-0.00701HF\times RT-0.393SFTT-0.13516SF\times CT-0.16283SF\times RT-0.2921TT\times CT0.13029TT\times RT-0.00545CT\times RT-0.56507TT^2-0.04641CT^2+0.44569RT^2 \quad (2).$$

In equation (2), HF is whether there is a dip or not, SF is whether shutoff after depositing the SiC layer is standard or alternate, TT is the time for depositing Ta, CT is the time for depositing SiC, and RT is the time for reactive ion etching.

A Balzers sputter apparatus was used in which wafers are placed on a rotatable rack for depositing Ta. Thus, TT represents the time in seconds/revolution of the rack.

In equation (2), all of the coefficients are in a −1, +1 system as they were in equation (1). As previously mentioned with respect to Table II, HF is +1 for a dip and −1 for no dip, and SF is +1 for alternate shutoff and −1 for standard shutoff.

In equation (2), TT represents a coded sputtering time for the Ta layer where coded sputtering time=(time−297)/149, CT represents a coded deposition time for the SiC layer where coded deposition time=(time−24.5)/24.5, and RT represents a coded reactive ion etch time where coded RT (time−20)/20. The coding forces the range of the levels of each these three parameters to be from −1 to +1.

Equation (2) predicts the average natural log of the life time for a printhead. The exponential of the average natural log of the life time for a printhead is the MTTF.

The failure times for the long-term life of printheads follow a log normal distribution. Therefore, the natural logs of the failure times were normally distributed as opposed to actual failure times.

If a printhead fails before one of its heaters or resistors fails, this results in a censored data point since the actual time to failure of a failed heater or resistor is not known. Since most regression software cannot handle censored data, these points were not utilized. Likewise, six early failures of the printhead were separated from the data; a simple outlier test demonstrated that the six failures were outliers.

After removing the outliers, a regression was performed on all of the failure times to obtain the coefficients of equation (2). Using equation (2), the optimal sputtering conditions for long term heater life were found using the "GridSearch" option of the STRATEGY Regression Software. In using the "GridSearch" option, the experimental space or "cube" is partitioned to the desired level (halves, quarters, etc.), and equation (2) is evaluated at each intersection. A criterion is chosen (for example, only those points which predict a MTTF>300 M), and the software finds those points to satisfy the "sweet spot," which provides the desired longest life.

By partitioning the experimental space or "cube" into sixteenths, the optimal sputtering conditions for heater life were a sputter time of 446 seconds for Ta, a deposition time of 49 minutes for SiC, RIE of 40 seconds, no HF dip, and standard SiC shutoff. Using all coefficients in equation (2), the predicted average natural log life of the printhead is about 5.94 with 95% confidence bounds of [4.4, 7.48]. The MTTF is $e^{5.94}$=379 M with a 95% confidence bounds of [81 M, 1769 M]. This produces a thermal ink jet printhead life approximately twenty times greater than the standard process, which has a MTTF of about 20 M. As a quick test of equation (2), the predicted MTTF under standard processing is 42 [27 M, 63 M]; the predicted MTTF of 42 M is close to the observed MTTF of 20 M.

To produce the highest predicted thermal ink jet printhead life, the RIE should be 40 seconds. If the RIE time is reduced to 0 seconds and all of the other conditions remain the same, the predicted MTTF would be reduced from 379 M to 191 M [113 M, 236 M]. Thus, the increase in life of the thermal ink jet printhead is not due solely is to the increased thickness of the Ta layer and the SiC layer although such will substantially increase the life of the thermal ink jet printhead in comparison with presently available thermal ink jet printheads.

If the HF dip and/or alternate SiC shutoff are used, the optimum MTTF will be decreased by a factor of at least 2. This may be due to the HF dip and also the SiC shutoff leaving a thin layer of contamination to reduce the adhesion between the SiC and Ta layers. While Table II discloses that run 7 produced the highest MTTF of 161 M [119 M, 218 M], equation (2) predicts that a much higher life is possible.

Figure 3:
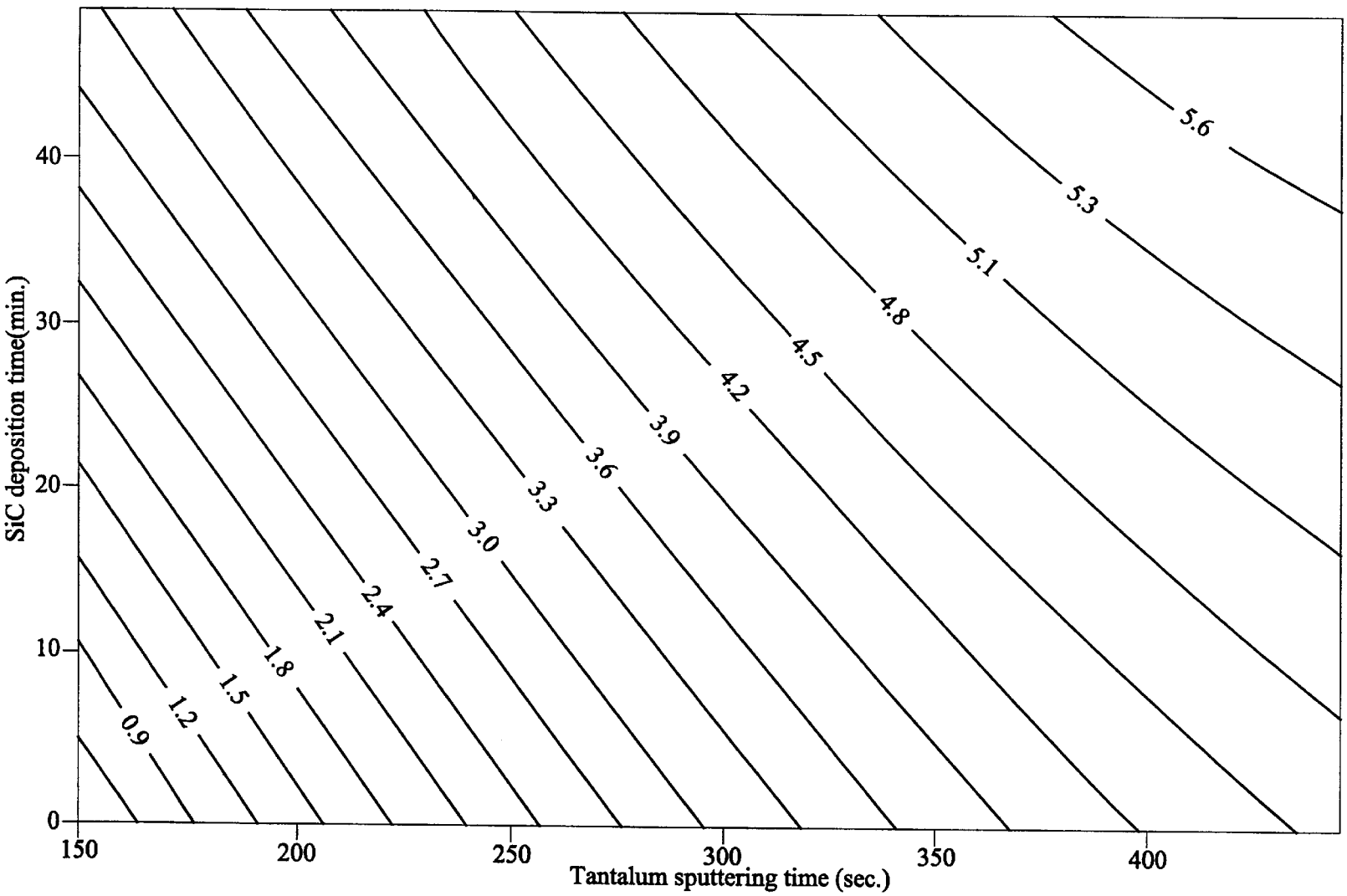
FIG. 3 is a contour plot showing the predicated average natural log of life of a three chamber, color printhead for different SiC and Ta deposition times.

The contour plot of FIG. 3 shows that the SiC and Ta thicknesses interact synergistically. In FIG. 3, there was no HF dip, the standard shutoff was used, and the RIE time was 40 seconds.

FIG. 3 discloses that increasing the Ta deposition time from 148 seconds to 446 seconds with no SiC deposition time results in the natural log of life increasing from about 0.4 to about 4.6. Accordingly, the MTTF increases from $e^{0.4}$=1 M to $e^{4.6}$=100 M.

From FIG. 3, a SiC deposition time of 49 minutes produces a natural log of life of about 2.9 for a Ta deposition time of 148 seconds to about 5.9 for a Ta deposition time of 446 seconds. Accordingly, MTTF increases from $e^{2.9}$=18 M to $e^{5.9}$=365 M. Therefore, gain in the MTTF from an increase in the thickness of the Ta layer is greater as the thickness of the SiC layer increases.

The formation of a layer of SiC with a thickness of 5,000 A and a layer of Ta with a thickness of 9,000 A (these were deemed to be the optimum conditions) were simulated to determine any increase in current pulse width necessary for formation of ink bubbles. The results are shown in FIG. 4 with a curve 10 representing when ink bubbles begin to be formed in a printhead formed with the standard process (a layer of SiC having a thickness of 2,600 A and a layer of Ta has a thickness of 6,000 A) and a curve 9 representing when ink bubbles begin to be formed in a printhead formed with a layer of SiC having a thickness of 5,000 A and a layer of Ta having a thickness of 9,000 A.

Figure 4:
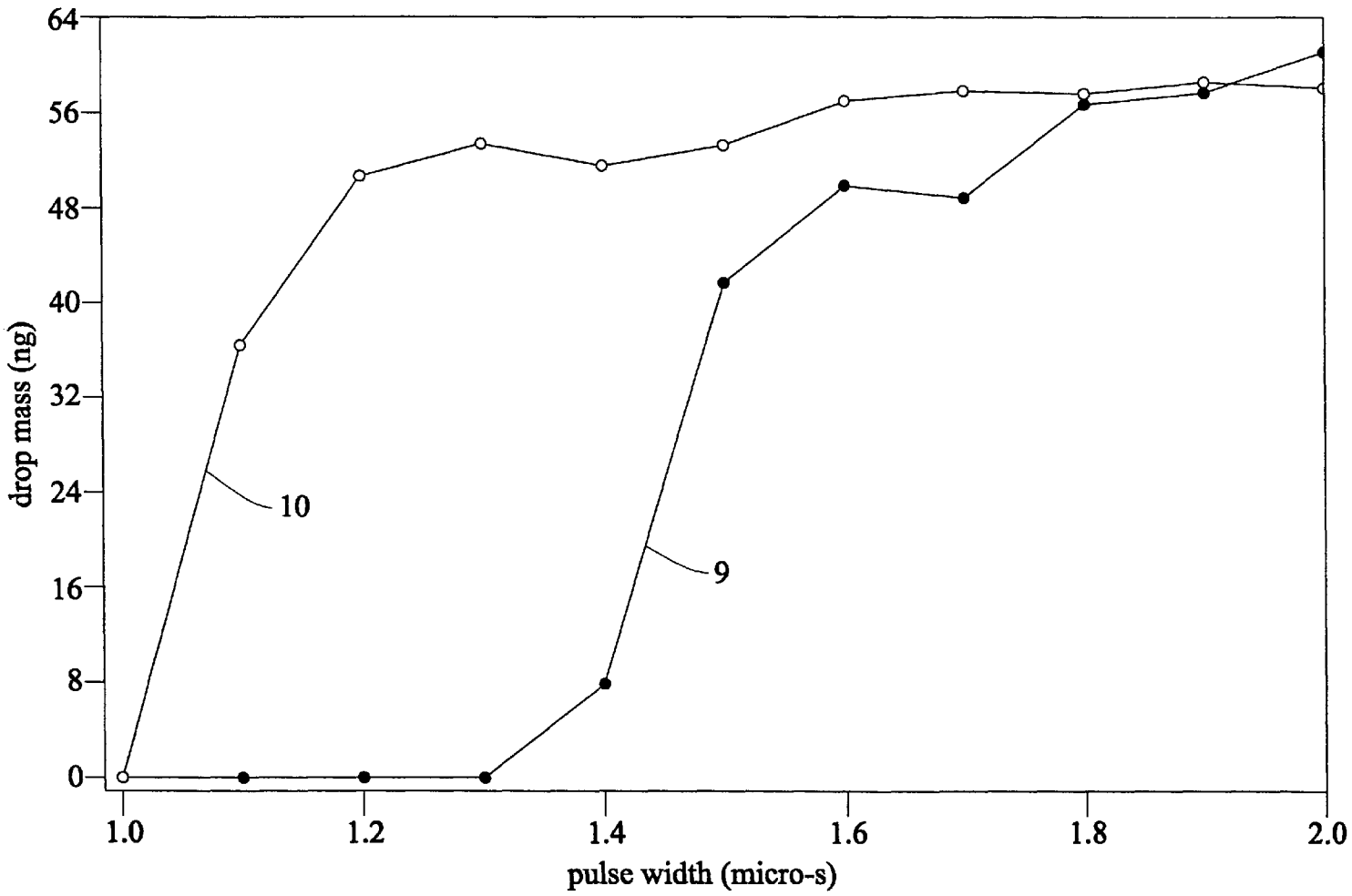
FIG. 4 is a graph showing the relation between drop volume and current pulse width for a thermal ink jet printhead formed by a standard process and for a thermal ink jet printhead formed with the optimum thicknesses of Ta and SiC.

FIG. 4 discloses that ink bubble formation will occur at a current pulse width of 1.3 microseconds for the increased thicknesses (curve 9) as compared to 1 microsecond for the standard process (curve 10). However, both reach the same bubble volume (size) at a 2 microsecond current pulse. Thus, the increased Ta and SiC thicknesses do not require an increase in the current pulse width beyond 2 microseconds for producing ink bubbles so that there is no effect on the current pulse width by the increased thickness of the protective layers of Ta and SiC as would be expected.

Figure 5:
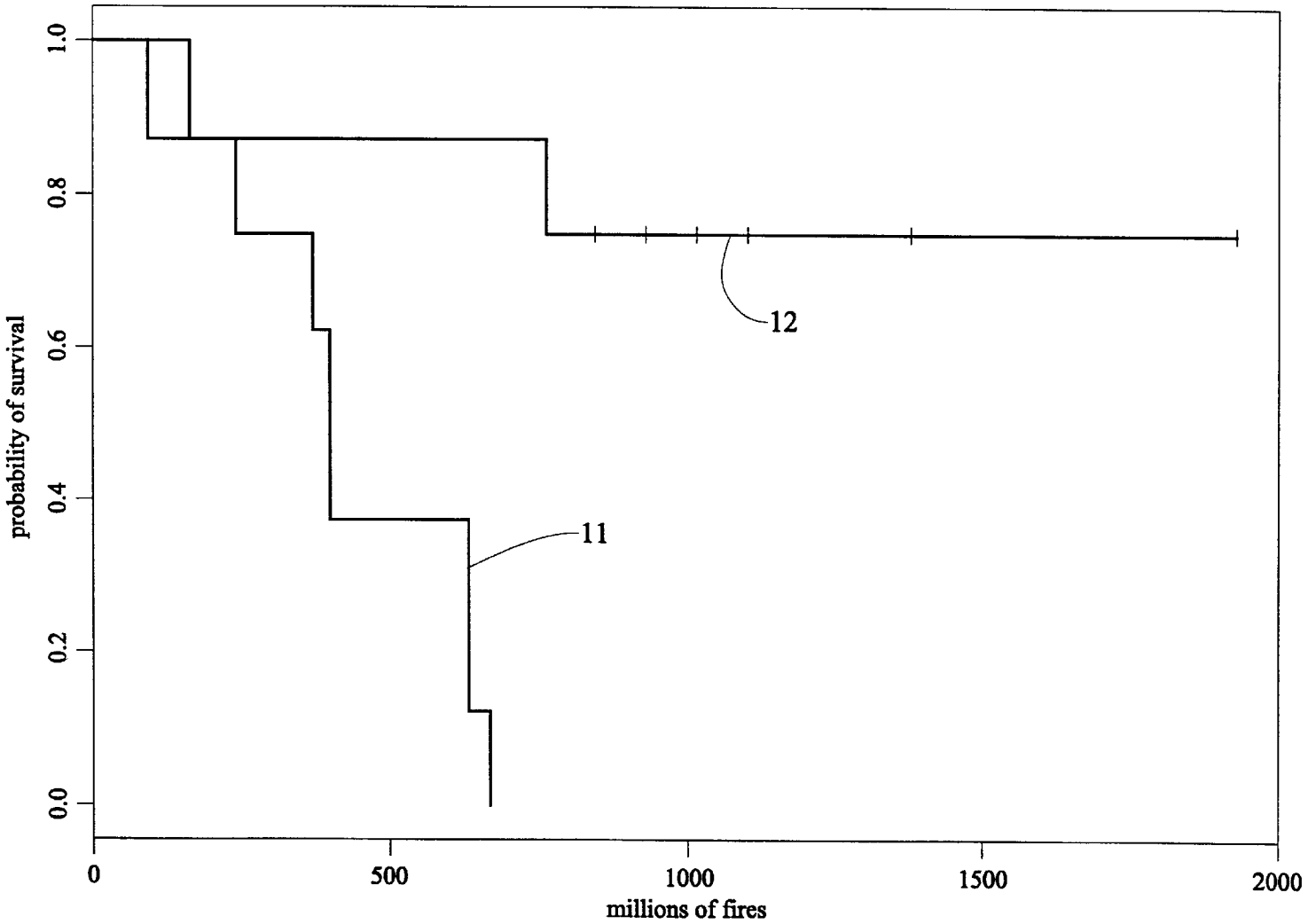
FIG. 5 is a graph showing the probability of survival of a single chamber, monochromatic ink jet printhead using only three controlled deposition conditions in comparison with the probability of survival of the single chamber, monochromatic ink jet printhead made without using these three controlled deposition conditions.

In FIG. 5, a curve 11 represents when each of a plurality of single chamber, monochromatic ink jet printheads, made by a manufacturer, failed. The heater chip was believed optimized by having the Ta layer sputtered to 9000 A and the SiC layer deposited by PECVD to 5000 A, using a PSE on the SiC. All failed due to heater failure before 1,000 million fires. The probability of survival of a printhead for millions of fires on the curve 11 were obtained by actual tests of the printheads in which they failed during millions of fires as follows: 166, 239, 373, 405, 410, 620, 627, and 660.

A curve 12 in FIG. 5 represents the same number of single chamber, monochromatic ink jet printheads as the curve 11 but formed with the optimum conditions of equations (1) and (2). The probability of survival of a printhead for millions of fires on the curve 12 were obtained by actual tests of the printheads in which they failed during millions of fires as follows: 78, 759, 843, 925, 1018, 1118, 1380, and 1921. However, only the first two failed due to heater failure while the remainder failed because of corrosion, not heater failure.

Figure 6:
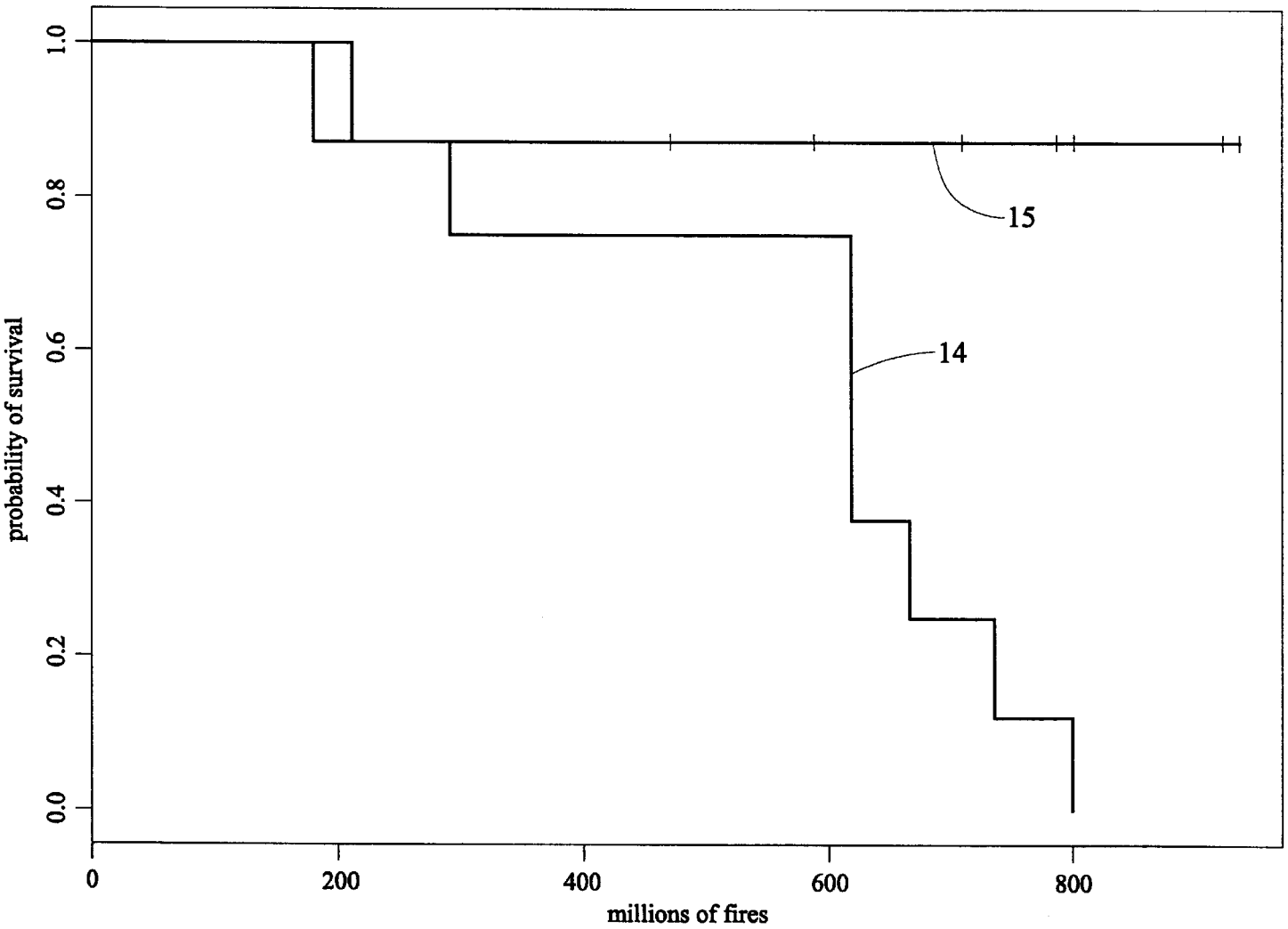
FIG. 6 is a graph showing the probability of survival of a three chamber, color ink jet printhead using only three controlled deposition conditions in comparison with the probability of survival of the three chamber, color ink jet printhead made without using these three controlled deposition conditions.

In FIG. 6, a curve 14 represents when each of a plurality of three chamber, color ink jet printheads failed. Each failed before 800 million fires.

The probability of survival of a printhead for millions of fires on the curve 14 were obtained by actual tests of the printheads in which they failed because of a heater failure during millions of fires as follows: 211, 291, 609, 618, 622, 663, 734, and 799.

A curve 15 represents the same number of the three chamber, color ink jet printheads as the curve 14 but formed with the optimum conditions of equations (1) and (2). The probability of survival of a printhead for millions of fires on the curve 15 were obtained by actual tests of the printheads in which they failed during millions of fires as follows: 178, 483, 594, 720, 791, 806, 928, and 943. However, only the first one failed due to heater failure while the remainder failed because of corrosion, not heater failure.

This shows that equations (1) and (2) may be used to select the conditions for any thermal ink jet printhead to increase its life. It is not limited to a specific thermal ink jet printhead.

Figure 7:
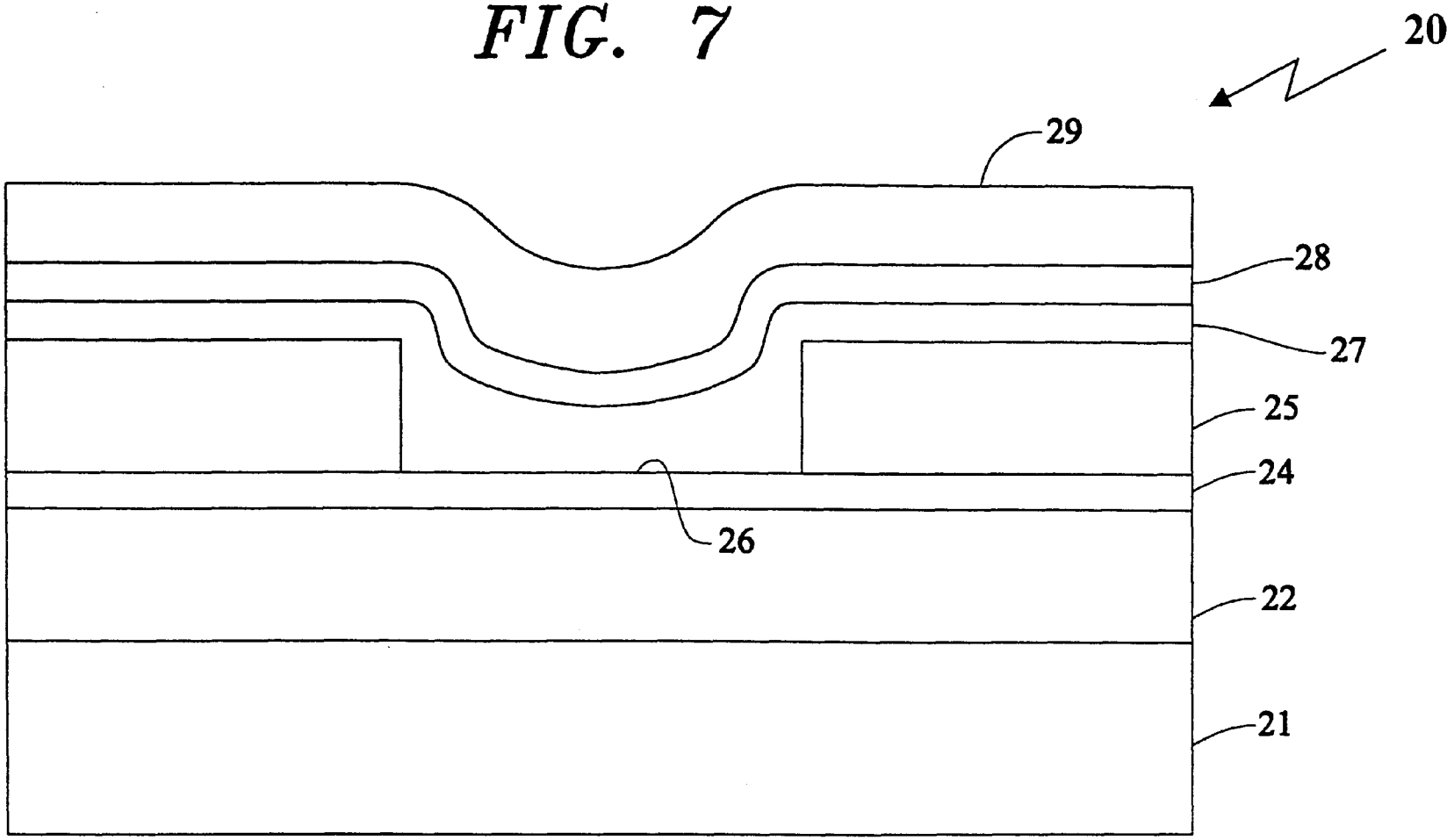
FIG. 7 is a schematic cross sectional view of a portion of a thermal ink jet printhead.

Referring to FIG. 7, there is shown a thermal ink jet printhead 20 having a silicon substrate 21 from which is grown a layer 22 of $SiO_2$. A resistive heating layer 24 of TaAl is deposited over the layer 22 of $SiO_2$. An electrically conductive layer 25 of aluminum is formed in a pattern to provide resistors or heaters 26 at exposed portions of the resistive heating layer 24 of TaAl between spaced portions of the electrically conductive layer 25 of aluminum.

A first protective layer 27 of $Si_3N_4$ overlies the electrically conductive layer 25 of aluminum. A second protective layer 28 of SiC is deposited over the layer 27 of $Si_3N_4$, and a third protective layer 29 of Ta overlies the layer 28 of SiC. The heater 26 heats ink, which overlies the Ta layer 28, when current is supplied through the aluminum layer 25 to each exposed portion of the resistive heating layer 24 of TaAl defining the heater 26.

If the printhead 20 is a single chamber, monochrome printhead, the protective layer 29 of Ta preferably has its thickness controlled in accordance with equation (1). If the printhead 20 is a three chamber color printhead, each of the protective layer 29 to of Ta and the protective layer 28 of SiC preferably has its thickness controlled in accordance with equation (2). However, each of the equations (1) and (2) may be utilized with the other printhead, if desired, or with any other thermal ink jet printhead.

An advantage of this invention is that optimum conditions for protective layers of an ink jet printhead can be obtained by using a regression equation. Another advantage of this invention is that the thickness of at least the protective Ta layer can be increased substantially without requiring any change in the current pulse width for producing ink bubbles.

For purposes of exemplification, preferred embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A thermal ink jet printhead including:

a rigid substrate;

a layer of heat insulating material overlying said substrate;

a resistive heating layer overlying said layer of heat insulating material;

an electrically conductive layer overlying only portions of said resistive heating layer to leave other portions of said resistive heating layer exposed to function as heaters for ink;

a protective layer of silicon nitride of a selected thickness overlying said electrically conductive layer and the exposed portions of said resistive heating layer;

a protective layer of silicon carbide of a selected thickness in a range of 3250 A to 5000 A overlying said protective layer of silicon nitride;

and a protective layer of tantalum of a selected thickness overlying said protective layer of silicon carbide, said protective layer of tantalum having a selected thickness greater than 7500 A and no greater than about 9000 A.

2. The thermal ink jet printhead according to claim 1 in which said protective layer of tantalum has a thickness of about 9000 A.

3. The thermal ink jet printhead according to claim 2 in which said protective layer of silicon carbide has a thickness of about 5000 A.

4. The thermal ink jet printhead according to claim 3 in which said protective layer of tantalum is deposited by sputtering only after a reactive ion etch or a pre-sputter etch is applied to said protective layer of silicon carbide.

5. The thermal ink jet printhead according to claim 2 in which said protective layer of tantalum is deposited by sputtering only after a reactive ion etch or a pre-sputter etch is applied to said protective layer of silicon carbide.

6. The thermal ink jet printhead according to claim 1 in which said protective layer of tantalum is deposited by sputtering only after a reactive ion etch or a pre-sputter etch is applied to said protective layer of silicon carbide.

7. The thermal ink jet printhead according to claim 1 in which said substrate is silicon.

8. The thermal ink jet printhead according to claim 1 in which said protective layer of tantalum is deposited on said protective layer of silicon carbide by sputtering.

* * * * *